US006007234A

United States Patent [19]

Steele

[11] Patent Number: 6,007,234

[45] Date of Patent: Dec. 28, 1999

[54] FLUID INJECTOR

[75] Inventor: James R. Steele, Stillwater, Minn.

[73] Assignee: Dynamic Air, Inc.

[21] Appl. No.: 09/114,191

[22] Filed: Jul. 13, 1998

[51] Int. Cl.[6] ..... B05B 1/32; B01F 13/02

[52] U.S. Cl. ..... 366/101; 239/533.14

[58] Field of Search ..... 366/101, 106, 366/107; 239/533.13, 533.14; 406/137; 222/195

[56] References Cited

U.S. PATENT DOCUMENTS

| | | | |
|---|---|---|---|
| 2,890,838 | 6/1959 | Jannsen | 239/533.13 |
| 3,334,819 | 8/1967 | Olavson | 239/533.13 |
| 3,351,292 | 11/1967 | Stuart, Sr. | 239/533.13 |
| 3,365,138 | 1/1968 | Green | 239/533.13 |
| 3,754,740 | 8/1973 | Piper | 239/533.13 |
| 3,952,956 | 4/1976 | Steele | 239/533.13 |
| 4,113,183 | 9/1978 | Stuart, Sr. | 239/533.13 |
| 4,172,539 | 10/1979 | Botkin | 366/107 |
| 4,556,173 | 12/1985 | Pausch et al. | 239/533.13 |
| 4,662,543 | 5/1987 | Solimar | 366/107 |
| 4,820,052 | 4/1989 | Krysel | 366/101 |
| 5,129,553 | 7/1992 | Becker | 222/195 |
| 5,139,175 | 8/1992 | Krysel et al. | 366/101 |

*Primary Examiner*—Tony G. Soohoo

[57] ABSTRACT

A fluid valve and bin aerator for discharging fluid into a chamber while preventing backflow of fluid through the fluid valve with the fluid valve including a resilient member having a set of annular sealing lips located in concentric alignment and at an angle to a sealing surface to provide lips that will cantilever away from the sealing surface and unseal if the pressure on the interior of the fluid valve is greater than on the exterior of the valve to allow fluid to be discharged from the valve, and will cantilever against the sealing surface if the pressure on the exterior of the valve is greater than the pressure on the inside of the valve to seal the fluid valve and inhibit backflow through the fluid valve.

28 Claims, 7 Drawing Sheets

FLUID INJECTOR

FIELD OF THE INVENTION

This invention relaters generally to fluid valves that prevent backflow and more particularly to a fluid injector or bin aerator that when attached to a pneumatic conveying system, ejects gas to dislodge materials that have accumulated on the walls of the pneumatic conveying system.

BACKGROUND OF THE INVENTION

The concept of bin aerators is old in the art as evidence by my U.S. Pat. No. 3,952,956, which discloses a bin aerator that has a deformable rubber housing for discharging air parallel to the walls of the bin. Generally, the bin aerators are periodically pulsed with a high pressure gas to discharge the gas into the pneumatic conveying system. At other times, gas may be continually discharged for an extended period of time. The resultant flow of gas around the deformable rubber housing dislodges the material adjacent the bin aerator. When the gas flow terminates, the deformable rubber housing collapses inwardly to seal off the gas passage and prevent backflow of material into the bin aerator.

In the present invention, an improved bin aerator incorporates a one-piece resilient domed member that has a sealing flap and multiple cantileverly held sealing lips that flex radially outward to allow gas to escape therefrom, but seal and seat themselves against a sealing surface when the gas pressure on the outside of the bin aerator is greater than the pressure on the inside of the bin aerator, thus preventing the backflow of gasses. The bin aerator is particularly suitable for use with abrasive materials, as the gas discharged from the bin aerator follows the angled sealing surface and is directed away from the wall of a pneumatic conveying device to thereby reduce abrasion caused by entrained particles. Also, the sealing lips are maintained in sufficiently strong pressure contact with a sealing surface so that as the scaling lips wear during use, the resilient member can still maintain an effective seal against the sealing surface. In addition, the bin aerator includes a housing that can be quickly mounted into a bin extension.

DESCRIPTION OF THE PRIOR ART

U.S. Pat. No. 3,952,956 discloses a bin aerator that has a deformable rubber housing for discharging air parallel to the walls of the bin.

SUMMARY OF THE INVENTION

Briefly, the present invention comprises a fluid valve or bin aerator for discharging fluid into a chamber while preventing backflow of fluid through the fluid valve, with the fluid valve including a resilient member having a set of annular sealing lips located in concentric alignment and at an angle to the sealing surface to provide lips that will cantilever away from the sealing surface to unseal if the pressure on the interior of the fluid valve is greater than on the exterior of the valve to allow fluid to be discharged from the valve, and will cantilever against the sealing surface if the pressure on the exterior of the valve is greater than the pressure on the interior of the valve to seal the fluid valve and inhibit backflow through the fluid valve.

DESCRIPTION OF THE PREFERRED EMBODIMENT

Figure 1:
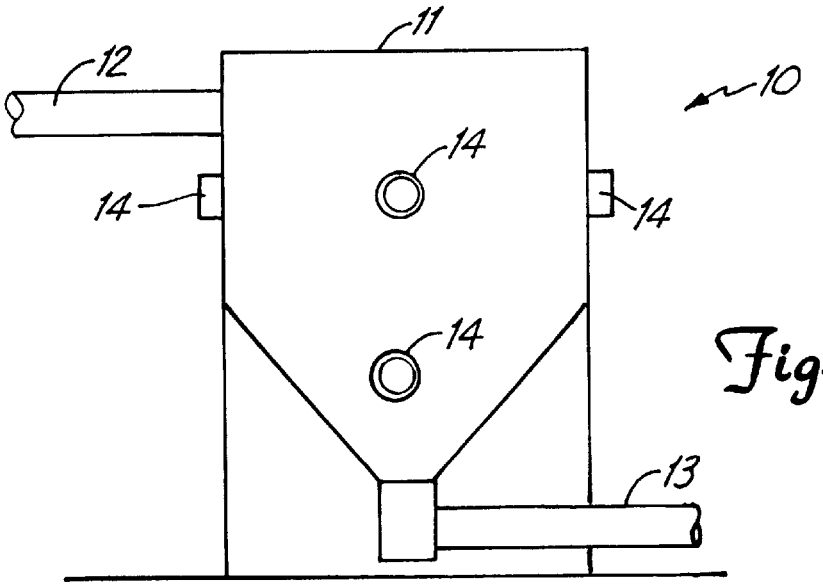
FIG. 1 is a front view of a pneumatic conveying system having bin extensions for mounting bin aerators therein.

FIG. 1 shows a front view of pneumatic conveying system 10 including a hopper 11 having an inlet conduit 12 and an outlet conduit 13 with a plurality of bin extensions 14 that are secured to the walls of the pneumatic conveying system for mounting bin aerator devices thereon.

Figure 3:
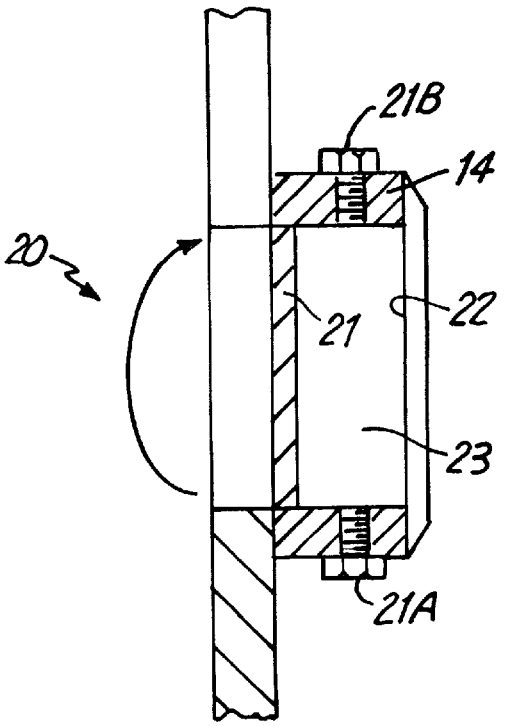
FIG. 3 is a partial side view of the bin extension of FIG. 2 with a bin aerator mounted therein.
Figure 2:
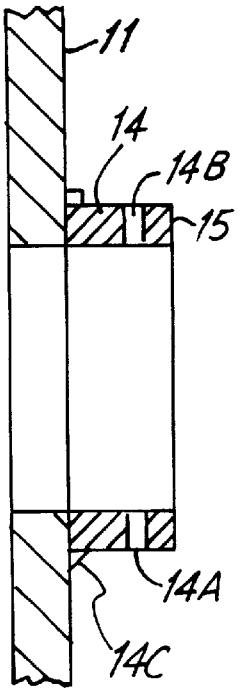
FIG. 2 is a partial side view of a bin extension.

FIG. 2 shows an enlarged view of a portion of the side wall of hopper 11 showing bin extension 14 secured thereto by a weld 14*c*. Bin extension 14 includes a pair of openings 14*b* and 14*a* for insertion of securing members therethrough. The outer annular edge 15 of bin extension 14 forms a stop when mounting a bin aerator thereon. FIG. 3 shows a bin aerator 20 mounted in the bin extension 14 with bin aerator 20 including a housing 23 and a sealing ring 21 located therearound to seal the housing 23 within the bin extension 14. A first securing member 21*b* extends through bin extension 14 and through housing 23 and a second securing member 21*a* extends through the opposite side of bin extension 14 and through housing 23 to hold bin aerator 20 in place. An annular lip or stop 22 located on housing 23 prevents bin aerator 20 from being accidentally dropped into hopper 11 during installation. Stop 22 also provides an automatic positioning device when the bin aerator needs to be replaced.

Figure 4A:
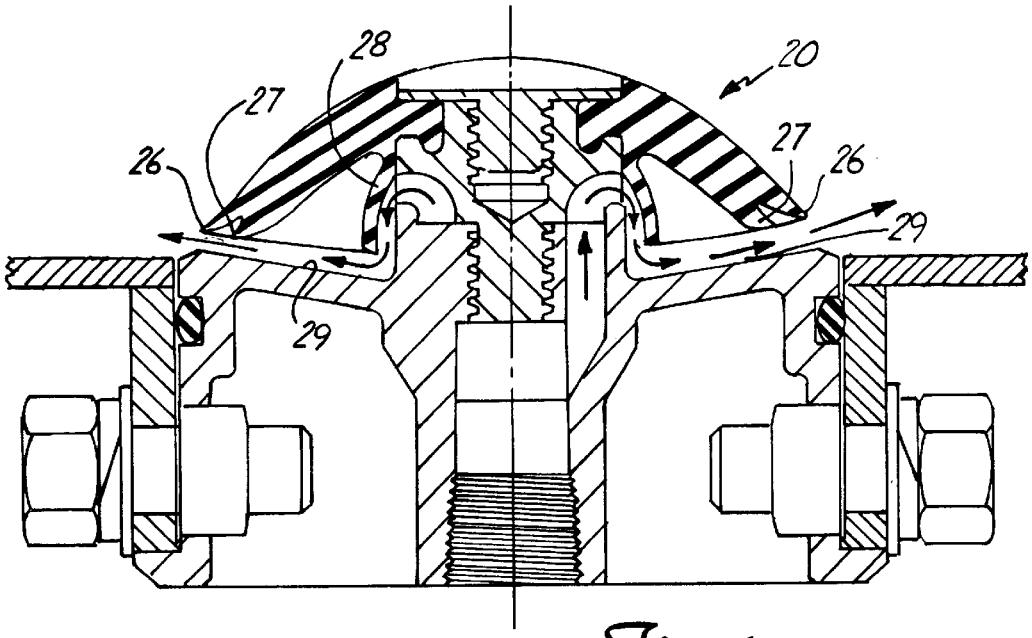
FIG. 4*a* is a cross-sectional view of a bin aerator mounted in the wall of pneumatic convening system in the open condition.
Figure 4:
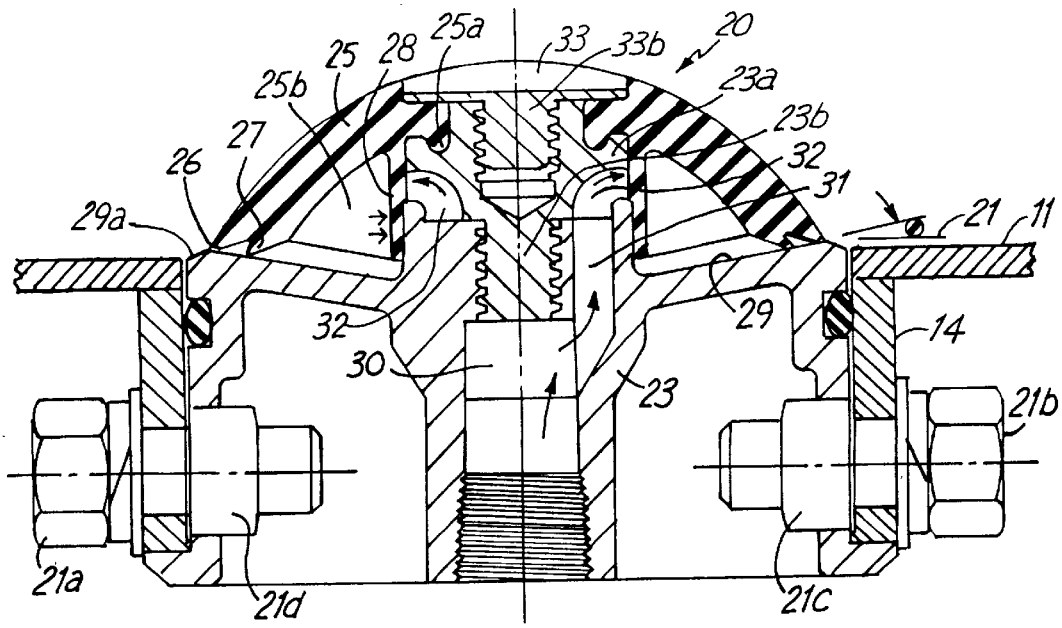
FIG. 4 is a cross-sectional view of a bin aerator mounted in the wall of pneumatic convening system in the closed condition.

FIG. 4 shows a partial side view of bin aerator 20 with bin aerator in the closed or backflow prevention condition. Bin aerator 20 includes a domed resilient member 25 which has a first annular sealing lip 26 which is cantilevered against annular seal surface 29 and a second annular sealing lip 27 which is concentrically located with respect to sealing lip 26. Second annular sealing lip 27 is also cantileverly held against annular seal surface 29. Sealing lips are shown as integrally connected with resilient member 25 and are both cantilevered and located at an acute angle to seal support surface 29. When the pressure of the gas in the interior of the housing 23 is greater than on the exterior o t the housing, it forces the sealing lips 26 and 27 away from the seal support surface 29, thus allowing gas to escape. Conversely, when the pressure of the gas on the exterior of the bin aerator 20 is greater than on the interior of the housing 23 it forces the cantilevered sealing lips 26 and 27 downward into sealing engagement with seal support surface 29 to inhibit backflow through bin aerator 20. Note that the natural default position for the bin aerator is in the closed position.

Bin aerator 20 also includes a cylindrical sealing flap 28 which extends over a set of radial passages 32 defined by housing 23 and 23*a*. In the closed condition as shown in FIG. 4, the sealing flap 28 prevents pressurized fluid that might have escaped past scaling lips 26 and 27 from entering the passages 32. Thus, with the present invention, one has three separate series barriers to prevent backflow into the fluid supply with the first barrier being sealing lip 26, the second barrier being sealing lip 27 and the third barrier being sealing flap 29. Each of the sealing barriers is constructed so that a higher pressure on the interior of the housing 23 than in the bin 11 will cause the sealing members to open and allow fluid therethrough, while a higher pressure in bin 11 will cause all three members to seal and inhibit backflow of fluids through the bin aerator 20. Note that the third sealing flap 28 is also integrally formed with the resilient member 25.

A plurality of web-like resilient ribs 25*b* are located in resilient member 25 for maintaining the structural integrity of the resilient member 25. That is, resilient ribs 25*b* which are radially spaced around member 25 (see FIG. 8) provide comparison support to prevent crushing of dome member 25 if the pressure on the exterior of bin aerator is too high. Similarly, the resilient ribs 25*b* provide tension support to prevent lips 26 and 27 from being cantilevered outward too far as the resilient members 25*b* connect to the circular sealing flap 28 that extends around housings 23 and 23*a*.

Resilient member 25 is held onto a two-part housing comprising a housing 23 having an upper portion 23*a* which together define gas passages 32 therethrough (See FIG. 4). That is, upper housing portion 23*a* contains threads 23*b* that engage a threaded recess in housing 23 to provide a single housing.

In order to secure resilient member 25 (See FIGS. 14 & 15) to housing 23*a*, a lock screw 33 is provided which includes a head with a slot 33*a* and threads 33*b* which engage a threaded recess in housing 23*a* to hold domed resilient member 25 in concentric alignment with the housing 23.

FIG. 4 shows that seal support surface 29 is located at a slight angle ø to a supporting wall 11 to thereby direct gas and material away from the supporting wall 11 which reduces wear on the supporting wall if the materials within the walls are abrasive.

FIG. 4*a* shows bin aerator 20 in the open condition with lips 26 and 27 cantilevered away from annular seal surface 29 to allow fluid to pass thereunder and away from supporting wall 11 as indicated by the arrows. Similarly, the sealing flap 28 is cantilevered outward at passage 32 to allow fluid to flow down to sealing surface 29 wherein it follows therealong and is discharged as indicated by the arrows. Thus, with the present invention, a slight displacement of the annular sealing lips allows the fluid to be discharged from the interior of the bin aerator to the region outside the bin aerator. In the embodiment shown, the annular sealing lips 26 and 27 are characterized by being less massive than the dome portion of the resilient member as both of the lips together have been formed with material of the same thickness as the domed portion of resilient member 25. The use of thinner, tapered wedge-like sealing lips provides for flexing and opening of the sealing lips in response to low differential pressure forces. That is, a pressure differential force between the inside and the outside of the bin aerator may not be sufficient to cause the massive dome material to flex, however, the smaller thinner tapered lips being less massive can respond to lower pressure differentials. In addition to the restraint provided by the massiveness of the domed resilient member 25, the ribs 25*b* act as a further restraint to radial outward extension of domed resilient member 25.

Sealing lips 26 and 27 are brought into pressure contact with seal surface 29 so that in the condition where there is no pressure differential across the bin aerator, the sealing lips 26 and 27 are deflected as they bear down on seal surface. By having the sealing lips 26 and 27 deflect as then bear down on seal surface 26 and 27 one can provide for wear of the sealing lips. That is, as the sealing lips wear due to usage, the sealing lips will continue to be held down until the wear is sufficient to prevent the deflection of the sealing lips. Consequently, the sealing lips can absorb wear and continue to function properly.

Figure 5:
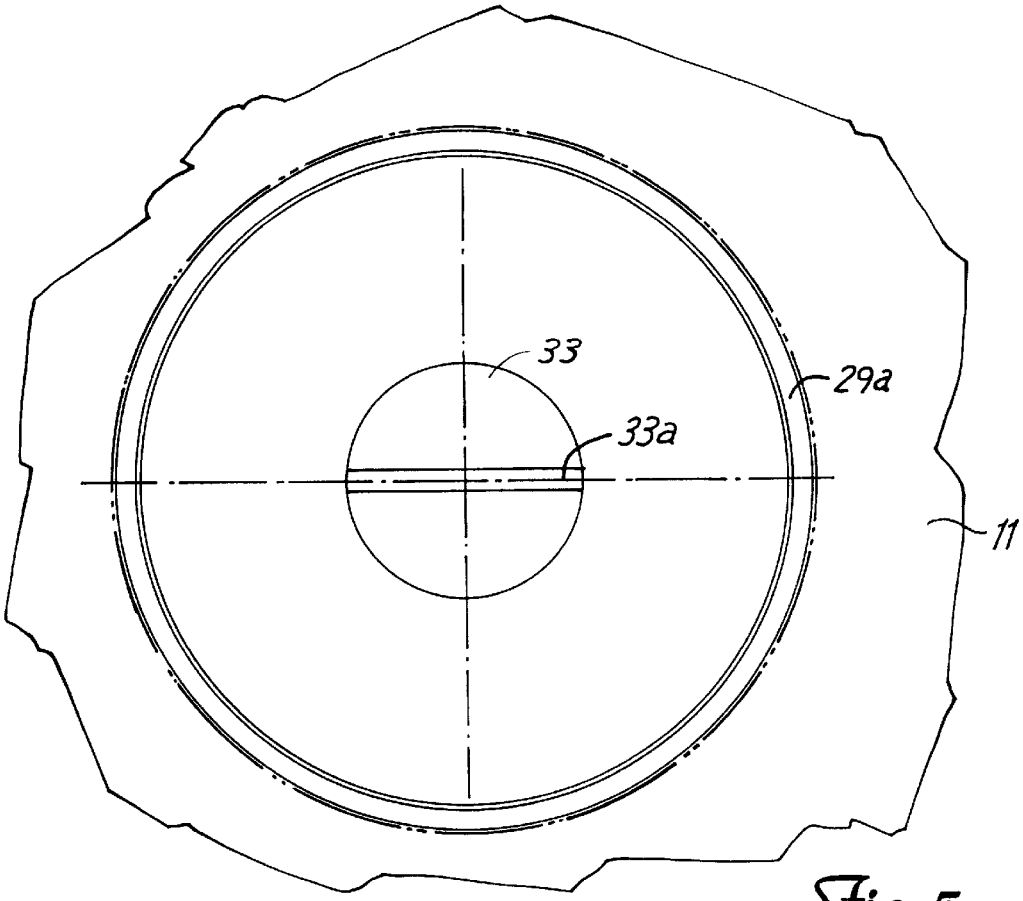
FIG. 5 is a top view of the bin aerator of FIG. 4.

FIG. 5 is a top view of the bin aerator 20 of FIG. 4 showing the locking screw 33 having a slot 33*a* for holding the annular resilient member 25 on bin aerator 20. The top view shows that the resilient member 25 is located concentrically with exterior annular surface 29*a* that adjoins seal surface 29.

Figure 6:
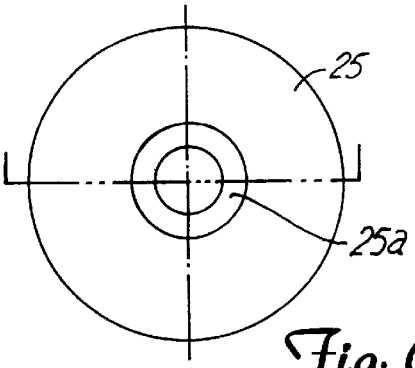
FIG. 6 is top X view of the resilient member of the bin aerator.

FIG. 6 is top view of the resilient member 25 of the bin aerator 20 that shows indented inner annular lip 25*a* for securing resilient member 25 to the housing of the bin aerator. The slot 33*a* of locking screw 33 snugly fits inside the indented annular lip 25*a* to keep it in place.

Figure 7:
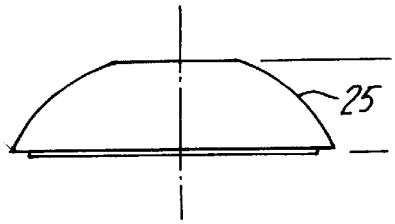
FIG. 7 is a side view of the resilient member of FIG. 6.

FIG. 7 is a side view of the resilient member 25 showing the dome shape of resilient member 25, and the flat top surface wherein locking screw 33 is placed.

Figure 8:
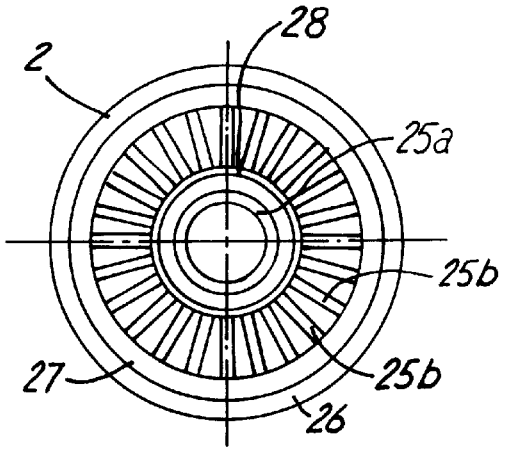
FIG. 8 is a bottom view of the resilient member of FIG. 6.

FIG. 8 is a bottom view of the resilient member 25 showing the circular sealing flap 28 position concentrically with respect to sealing lips 26 and 27. A plurality of ribs 25*b* extend radially outward from scaling flap 28 to a position proximate sealing lip 27. Ribs 25*b* provide multiple purposes. First, they provide support to prevent crushing of the resilient member from undue pressure differentials and second they prevent the sealing lips 26 and 27 from opening too wide so that material cannot get trapped in resilient member 25 before the resilient member can be closed.

Figure 9:
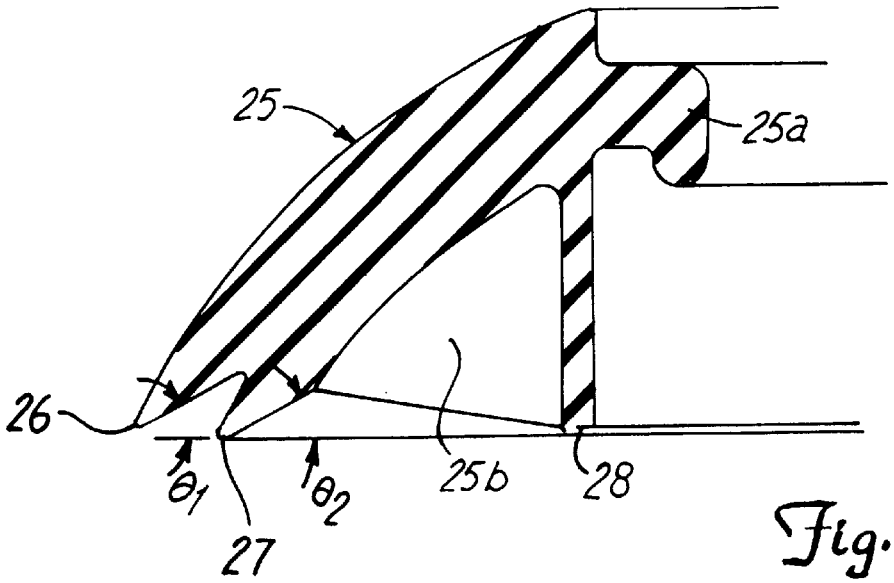
FIG. 9 is a partial enlarged view of the sealing lips and sealing flap of the resilient member of FIG. 6.

FIG. 9 is a partial enlarged view of the sealing lips 26 and 27 and sealing flap 28 of the resilient member 25. The sealing lips are shown having inner surface angles $ø_1$ and $ø_2$ at about 30 degrees. The lips are shown being integrally formed from the more massive resilient member 25 and consequently, are of less thickness than the massive resilient member 25. In addition, the sealing lips 26 and 27 are sufficiently short so that when they flex upwardly in response to pressure forces, the amount of clearance between the sealing lips and the seal surface remains low. An indented annular lip 25*a* is integrally formed with resilient member 25 so that the resilient member 25 can be secured to housing 23 by a single lock screw. Sealing flap 28 is also integrally formed into resilient member 25 to produce a single member that carries three sealing members, namely sealing flap 28, sealing lip 26 and sealing lip 27 that are located in series in the fluid flow path to inhibit backflow through the bin aerator.

Figure 10:
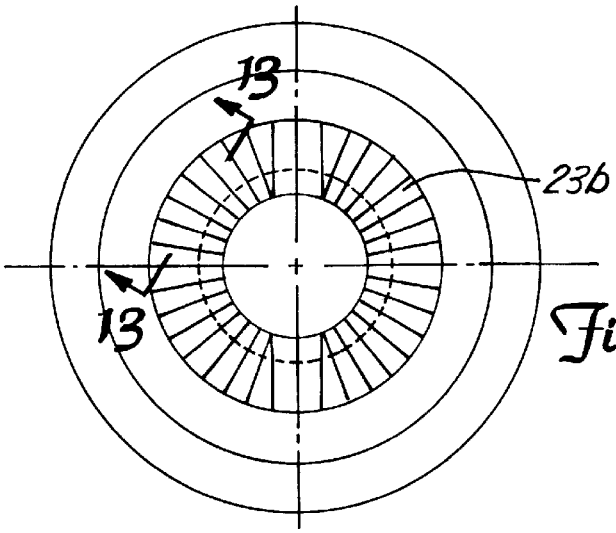
FIG. 10 is a top view of a portion of the housing of the bin aerator.
Figure 13:
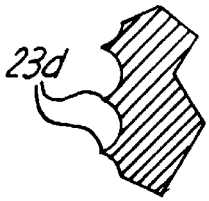
FIG. 13 is partial view taken along lines 13—13 of FIG. 10.

FIG. 10 shows a top view of a portion of the housing 23*a* of the bin aerator with the housing 23*a* including a set of radial locking ridges 23*d* thereon which are shown in detail in FIG. 13. The locking ridges 23*d* engage a set of radial ridges in the locking screw 33 to hold the locking screw in position and prevent accidental loss of the resilient member during operation of the system.

Figure 11:
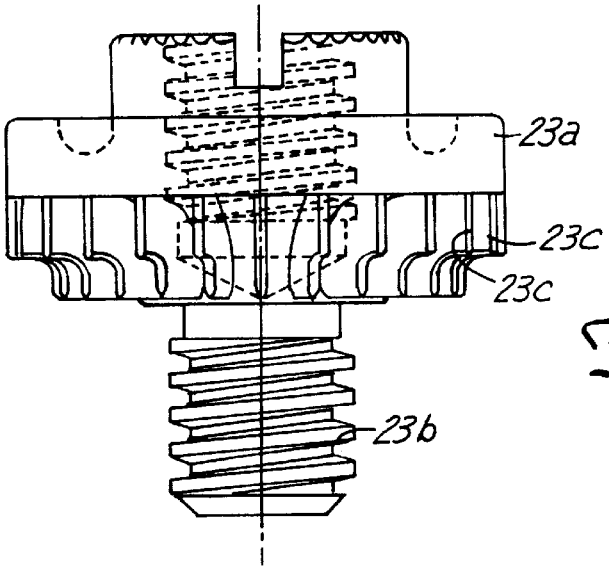
FIG. 11 is side view of the portion of the housing of the bin aerator shown in FIG. 10.

FIG. 11 is a side view of the portion of the housing identified by 23*a* with the housing including a series of radial vanes 23*c* that provide passages therebetween for directing fluid radially outward.

Figure 12:
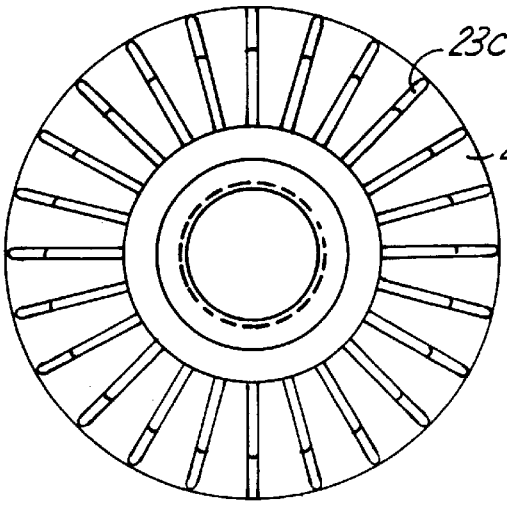
FIG. 12 is bottom view of the portion of the housing of the bin aerator shown in FIG. 10.

FIG. 12 shows a bottom view of the portion of the housing 23*a* revealing the radial vanes 23*c* which extend radially outward in the housing 23*a*.

Figure 14:
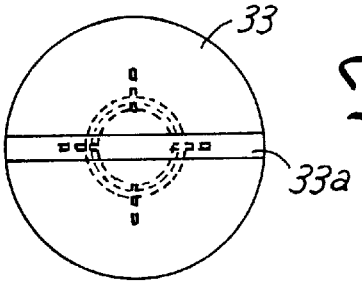
FIG. 14 is a top view of a locking screw for securing resilient member of FIG. 6 to the housing member of 10.
Figure 15:
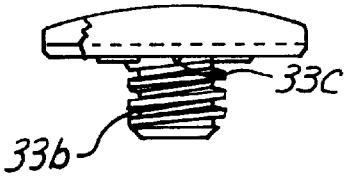
FIG. 15 is a side view of the locking screw of FIG. 14.
Figure 17:
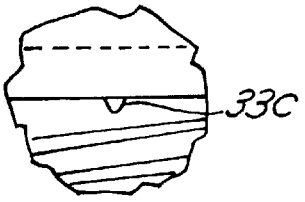
FIG. 17 is an enlarged view of a locking ridge on the locking screw of FIG. 14.
Figure 16:
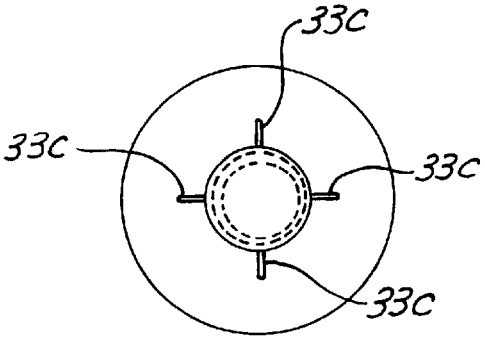
FIG. 16 is a bottom view of the locking screw of FIG. 14.

FIGS. 14–17 show the locking screw 33 for holding resilient member 25 on housing 23*a*. FIG. 14 is a top view of a locking screw 33 showing the slot 33*a* for rotating of locking screw 33. FIG. 15 is a side view of the locking screw 33 showing the thread 33*b* and the radial locking ridges 33*c* which are shown in enlarged view in FIG. 17. FIG. 16 is a bottom view of the locking screw 33 showing the quadrant position of locking ridges 33*c* on the underside of locking screw 33. Locking ridges 33*c* engage the radial ridges 23*d* (FIG. 10) of housing 23*a* and when in engagement therewith prevent the locking screw from accidentally working loose during use of the bin aerator.

Figure 18:
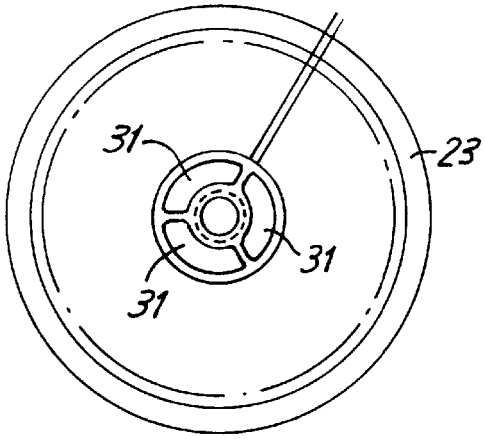
FIG. 18 is a top view of housing of the bin aerator.
Figure 19:
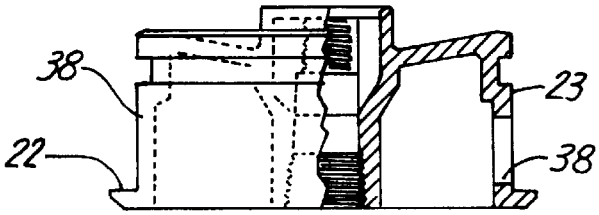
FIG. 19 is partial side view of the bin aerator housing shown in FIG. 18.
Figure 21:
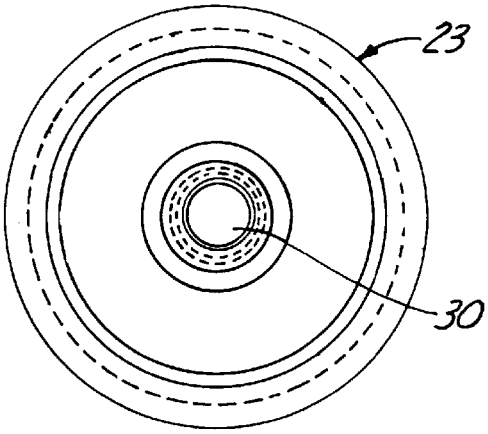
FIG. 21 is a bottom view of the bin aerator housing shown in FIG. 18.
Figure 20:
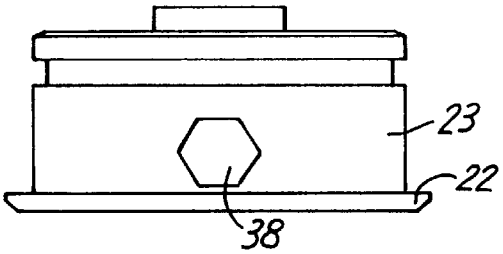
FIG. 20 is a side view of the bin aerator housing shown in FIG. 18.

FIGS. 18–20 show the lower housing 23, with FIG. 18 showing a top view of housing 23 revealing three fluid passages 31 located concentrically with housing 3. FIG. 19 is a partial side view of the lower housing 23 wherein the catch lip 22 is shown. FIG. 20 is a full side view showing one of the two nut relief areas 38 for engaging a side of a nut so that a fastener can be secured thereto with the use of only a single wrench. That is, a nut fits into the nut fastening area and is prohibited from turning as a bold is threaded therein. FIG. 21 is a bottom view of the bin aerator housing showing the central fluid passage 30.

In operation, a user attaches the lower housing unit 23 to a bin extension 14 using two nuts fastened through the nut relief areas 38. Catch lip 22 prevents the lower housing 23 from falling out of the bin extension 14 during installation. At this point, fluids may move freely back and forth through the radial passages 32, the fluid passage 31, and the central fluid passage 30. The purpose of this invention is to regulate that flow, and the complete construction will illustrate that purpose. As FIG. 4 shows, annular lip 25*a* rests on top housing 23*a* to prevent the lips 26 and 27 from flattening out against annular seal surface 29 when the screw 33 is fastened. The screw 33 is fastened into the top housing 23*a*, firmly securing the resilient member 25 in the process. The resilient member rests sufficiently close to the annular seal surface 29 so as to allow the lips 26 and 27 to distend lightly and create a seal, but also sufficiently high up enough so as to not flatten out the lips 26 and 27 entirely, thus preventing fluid motion at all.

In operation, if the pressure inside the bin aerator is at a higher pressure than the hopper, the gas will travel through conduits 30, 31, and 32, push past sealing flap 28, flow under resilient cap 25, past lips 27 and 26 and into the hopper. It should be noted that as soon as the pressures inside and outside of the container are equalized, the sealing flap 28 will close, thus immediately preventing any backflow into the bin aerator. When the pressure inside and outside of the hopper is equalized, the resilient member 25 will maintain its normal shape, and force sealing flap 28, lips 26 and 27 into place to prevent backflow of fluids into the bin aerator. It should also be noted that because the resilient member 25 is attached to the bin aerator device 20 using only a single screw 33, it is easily replaceable when the lips become worn. Pressurized air is sent through the lower housing of the bin aerator, through the top housing, pushing past the lips anf flap of the resilient member, and dislodging an y materials attached to the side of the hopper.

I claim:

1. A fluid injector for directing a fluid therefrom comprising:

a housing, said housing having a seal support surface thereon and a fluid passage therein for directing fluid over said seal support surface;

a resilient member, said resilient member secured to said housing;

a first sealing lip located on said resilient member, said first sealing lip normally engaging said seal support surface to prevent backflow of fluid past said first sealing lip when the pressure of fluid within said housing is less than the pressure of fluid outside the housing; and a second sealing lip located on said resilient member, said second sealing lip normally engaging said seal support surface to further prevent backflow of fluid past said second sealing lip with said first sealing lip and said second sealing lip displaceable from said seal support surface when the pressure of fluid within said housing is greater than the pressure of fluid outside of said housing to permit fluid to be discharged from said fluid injector.

2. The fluid injector of claim 1 wherein said fluid injector includes a resilient flap for further prevention of backflow through said fluid injector.

3. The fluid injector of claim 2 wherein said fluid passage is positioned normal to said resilient flap.

4. The fluid injector of claim 2 wherein said resilient flap is integral with said resilient member.

5. The fluid injector of claim 3 wherein said resilient flap is cylindrical.

6. The fluid injector of claim 4 wherein said resilient member is centrally supported on said housing.

7. The fluid injector of claim 6 including a lock screw for holding said resilient.

8. The fluid injector of claim 1 wherein said resilient member has a dome portion with the dome portion having greater massiveness than said sealing lips.

9. The fluid injector of claim 1 wherein said first sealing lip is annular.

10. The fluid injector of claim 9 wherein said second sealing lip is annular and said second sealing lip is concentric with said first sealing lip.

11. The fluid injector of claim 1 wherein said first sealing lip engages said seal support surface at an acute angle.

12. The fluid injector of claim 1 wherein said second sealing lip engages said seal support surface at an acute angle.

13. The fluid injector of claim 1 including a plurality of resilient ribs in said resilient member for maintaining the structural integrity of said resilient member.

14. The fluid injector of claim 1 wherein the housing includes a plurality of radial discharge passages for directing fluid over said seal support surface.

15. The fluid injector of claim 1 wherein said resilient member is an elastomer.

16. The fluid injector of claim 1 wherein said seal support surface is annular.

17. The fluid injector of claim 1 including a sealing ring for scaling said fluid injector in a hopper.

18. The fluid injector of claim 1 including a hopper having an annular bin extension.

19. The fluid injector of claim 18 wherein the annular bin extension includes a lip thereon and said housing includes a stop for engaging the lip to prevent the fluid injector from falling into said hopper.

20. The fluid injector of claim 19 wherein said housing includes a nut securing relief to prevent turning of a nut located in said nut securing relief.

21. A bin aerator for directing a gas therefrom comprising:

a housing, said housing having a seal support surface thereon and a fluid passage therein for directing fluid over said seal support surface;

a resilient member, said resilient member secured to said housing; and a first sealing lip located on said resilient member, said first sealing lip normally engaging said seal support surface to prevent backflow of fluid past said first sealing lip when the pressure of fluid within said housing is less than the pressure of fluid outside the housing, a second sealing lip located on said resilient member, said second sealing lip normally engaging said seal support surface to further prevent backflow of fluid past said second sealing lip with said first sealing lip and said second sealing lip displaceable from said seal support surface when the pressure of fluid within said housing is greater than the pressure of fluid outside of said housing to permit fluid to be discharged form said fluid injector.

22. The bin aerator of claim 21 wherein said sealing lips are located at an acute angle to said seal support surface so that when the pressure of the gas in the interior of the housing is greater than on the exterior of the housing, it forces the sealing lips away from the seal support surface, and when the pressure of the gas on the exterior of the housing is greater than on the interior of the housing it forces the sealing lips into sealing engagement with said seal support surface to inhibit backflow through said bin aerator.

23. A bin aerator for directing a gas therefrom comprising:

a housing, said housing having a seal support surface thereon and a fluid passage therein for directing fluid over said seal support surface;

a resilient member, said resilient member secured to said housing; and a first sealing lip located on said resilient member, said first sealing lip normally engaging said seal support surface to prevent backflow of fluid past said first sealing lip when the pressure of fluid within said housing is less than the pressure of fluid outside the housing, wherein said bin aerator includes a sealing flap for preventing backflow through said housing.

24. The bin aerator of claim 23 wherein said bin aerator includes resilient ribs to assist in maintaining the structural integrity of the resilient member as the resilient member distorts in response to gas pressure.

25. The bin aerator of claim 24 wherein said bin aerator resilient member comprises a domed member having a central extension for securing said resilient member to said housing to thereby permit an outer portion of said resilient member to move and flex in response to differences in gas pressure between the inside of said housing and outside of said bin aerator.

26. The bin aerator of claim 23 wherein said resilient member and said sealing flap comprise one piece.

27. The bin aerator of claim 23 wherein said seal support surface is located at an angle to a supporting wall to thereby direct gas and material away from the supporting wall to reduce wear on the supporting wall.

28. The bin aerator of claim 23 wherein said sealing flap, said first sealing lip and said second sealing lip extend completely around said resilient member.

* * * * *